US009147561B2

(12) United States Patent
Rolff

(10) Patent No.: US 9,147,561 B2
(45) Date of Patent: Sep. 29, 2015

(54) METHOD FOR DETERMINING THE MAXIMUM MASS PEAK IN MASS SPECTROMETRY

(71) Applicant: Inficon GmbH, Cologne (DE)

(72) Inventor: Norbert Rolff, Horrem (DE)

(73) Assignee: Inficon GMBH, Cologne (DE)

( * ) Notice: Subject to any disclaimer, the term of this patent is extended or adjusted under 35 U.S.C. 154(b) by 0 days.

(21) Appl. No.: 14/381,170

(22) PCT Filed: Feb. 28, 2013

(86) PCT No.: PCT/EP2013/054055

§ 371 (c)(1),
(2) Date: Aug. 26, 2014

(87) PCT Pub. No.: WO2013/127933

PCT Pub. Date: Sep. 6, 2013

(65) Prior Publication Data

US 2015/0014523 A1 Jan. 15, 2015

(30) Foreign Application Priority Data

Feb. 29, 2012 (DE) ..... 10 2012 203 137

(51) Int. Cl.
*H01J 49/26* (2006.01)
*H01J 49/00* (2006.01)

(52) U.S. Cl.
CPC ..... *H01J 49/0036* (2013.01); *H01J 49/26* (2013.01)

(58) Field of Classification Search
USPC ..... 250/281, 282; 702/19, 22, 26, 27, 28
See application file for complete search history.

(56) References Cited

U.S. PATENT DOCUMENTS

| | | | | |
|---|---|---|---|---|
| 2005/0151073 | A1 | 7/2005 | Kato | |
| 2005/0263697 | A1 * | 12/2005 | Hager et al. | 250/292 |
| 2012/0109537 | A1 * | 5/2012 | Makarov | 702/27 |
| 2013/0274143 | A1 * | 10/2013 | Emanuele et al. | 506/12 |

FOREIGN PATENT DOCUMENTS

| | | | |
|---|---|---|---|
| DE | 10 2005 028 557 | A1 | 1/2007 |
| WO | 2004/106881 | A2 | 12/2004 |

* cited by examiner

*Primary Examiner* — Nicole Ippolito
(74) *Attorney, Agent, or Firm* — Craig Metcalf; Kirton McConkie

(57) ABSTRACT

A fast method for determining molecular mass using mass spectrometry has the following steps: specifying a first adjusting value (M1) of the mass spectrometer, recording the associated signal amplitude (A1), specifying a second adjusting value (M2) which is different to the first, measuring the associated second signal amplitude (A2), specifying a third adjusting value (M3) which is different to the first (M1) and the second (M2) adjusting value, measuring the associated third signal amplitude (A3), determining a quadratic function containing the measured amplitude values as y-values and the specified adjusting values as x-values, determining the maximum of the quadratic function, wherein the searched adjusting value is determined from the x-value of the maximum.

8 Claims, 1 Drawing Sheet

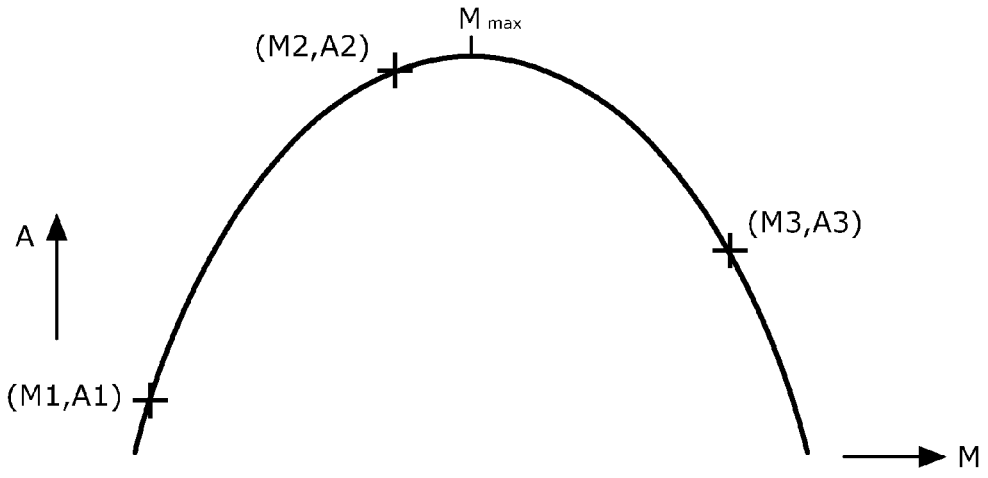
M max
(M2,A2)
(M3,A3)
A
(M1,A1)
M

METHOD FOR DETERMINING THE MAXIMUM MASS PEAK IN MASS SPECTROMETRY

This application is a National Stage of International Application No. PCT/EP2013/054055, filed Feb. 28, 2013, and entitled METHOD FOR DETERMINING THE MAXIMUM MASS PEAK IN MASS SPECTROMETRY, which claims the benefit of DE 10 2012 203 137.5, filed Feb. 29, 2012. This application claims priority to and incorporates herein by reference the above-referenced applications in their entirety.

The invention relates to a method for determining the maximum of the mass peak of the molecules measured with the aid of mass spectrometry.

Mass spectrometers are used for analysis of gases and find application particularly in leak detection devices. In such a case, the substance to be examined will be ionized in the gaseous phase and be supplied to an analyzer. In sector-field mass spectrometers, the anode voltage determines the set value for the mass position. Between a cathode and an anode, there is generated an electric field which will accelerate the electrons issuing from the cathode, which electrodes are ionizing the existing gas molecules. The charged electrons will be accelerated by the anode potential and, after passing the separation system, will reach the captor. In the separation system, a magnetic field is arranged which will deflect the ions. Ions which are too heavy will be deflected by the magnetic field too slightly while those ions which are too light-weighted will be deflected too strongly. Only the ions in the correct mass range will pass through the separation system. The anode potential is determinant of the mass passing through the separation system. In the range of a mass, a signal amplitude is generated which depends on the exact anode potential to the effect that, in case of a too small or too large anode potential, the signal amplitude will become smaller than the maximum. In other mass spectrometers, e.g. quadrupole mass spectrometers, the conditions are comparable so that the same method is applicable.

An adjustment is required so that, in each case, the maximum possible signal amplitude of the respective mass can be obtained. In order to adjust the mass spectrometer to the mass maximum, it is conventional practice to perform mass scans at respectively about 20-100 measurement points. Thus, in a way, the development of the signal amplitudes toward the associated set values is measured in close intervals. After a measurement, the maximum amplitude value of the measurement will be detected and, in the range around this value, a renewed measurement will be carried out at about 20-100 measurement points in closer intervals. In this manner, the maximum of the amplitude development is detected in a plurality of successive measurements until the resolution of the measurement is of sufficient accuracy. Also one scan with sufficient resolution is possible but will take much time. The set value of the maximum amplitude value of the last measurement will then be used as the set value for identification of the molecular mass. Because of the large number of measurement points to be captured and the multiple measurements to be performed after one another, the conventional methods for determining the mass maximum are time-consuming.

It is an object of the invention to provide a faster method for determining the mass adjustment for mass spectrometry.

The method of the invention is defined by the features according to claim 1.

It is accordingly provided that respective signal values will be captured for at least three different set values and respectively anode voltages. If the first or the last amplitude value is at a maximum, the measurement for other set values will be repeated until a measured signal amplitude between the first and the last measured signal amplitude is at the maximum. Prior to capturing each respective measurement point, it is preferably waited until the amplitude signal has become stabilized. The measured amplitude values and the associated set values will be stored as measurement points. Thereafter, a quadratic function will be computed which includes the measurement points. The maximum of the quadratic function will be detected and be used for determining the maximum of the set values for the desired molecular mass.

According to the invention, the measurement is performed with at least three different set values and with not more than ten set values. Preferably, during a measurement, only three measurement points will be captured. Thus, as compared to the conventional methods, the number of captured measurement points is distinctly reduced, allowing the measurements to be carried out noticeably faster. Further, by determining the maximum of a quadratic function containing the measurement points, there is obviated the need for successive measurements, which again allows for faster determination of the molecular mass. The invention is based on the idea of drawing conclusions on the actual development of the measurement signal from merely a few measurement values without measuring the development in its entirety.

Said quadratic function typically is a parable of the type $y=ax^2+bx+c$. Herein, the x-values constitute the mass axis, i.e. the predefined set values, and the y-values are the measured amplitude values for each set value. The constants a and b can be determined after an equation system has been established for the measurement points. Subsequently, the x-value of the maximum of the function will be determined by forming the first derivative of the quadratic function. The x-value corresponding to the maximum is the set value of the searched molecular mass.

In case that the first one or the last one of the captured amplitude values should happen to be maximal, this is an indicator that the searched maximum does not lie between these two measurement values. Since the amplitude function does not exactly correspond to a parable, it is advisable to repeat the measurement for a new range of set values, wherein the first set value corresponds to the last set value of the respective previous measurement. In this manner, the measurements are repeated until a maximum amplitude measurement value between the respective first and the respective last set value of a measurement has been reached. Provided that the set values have been correctly selected, it will normally be already at the first measurement that the intermediate value is larger than the adjacent values. For the measurement values of this last measurement, the maximum will then be determined according to the above described method.

The accuracy of the method of the invention can be increased in that, as soon as a maximum amplitude value between the first and the second set value has occurred, there will be captured, around this amplitude value, further amplitude values for more-closely adjacent set values. Thus, this is to say—in other words—that the distances of the set values of the repeated measurement to the set value of the maximum amplitude value are smaller than in the respective previous measurement.

An embodiment of the invention will be explained in greater detail hereunder with reference to the Figure. The Figure shows a graphic representation of the measurement values according to the invention.

First, for three different set values M1, M2 and M3, the resulting amplitude values A1, A2 and A3 will be measured. The measured amplitude values A1, A2 and A3 will be stored together with the associated set values M1, M2 and M3 in the form of coordinate pairs (M1, A1) (M2, A2) and (M3, A3). In the Figure, the coordinate pairs are plotted as points in a coordinate system. In this coordinate system, the x-axis corresponds to the set values, i.e. to the mass axis M, and the y-axis is the appertaining amplitude axis A.

The Figure shows that the amplitude value A2 of the intermediate set value M2 is larger than the amplitude values A1 and A3 of the first set value M1 and of the last set value M3. This means that that the maximum of the searched development is situated between the first set value M1 and the third set value M3. If this should not be the case, the measurement would have to be repeated, wherein the first set value M1 of a subsequent measurement corresponds to the set value M3 of the respective previous measurement so that no range will be omitted.

After capturing the three measurement points (M1, A1) (M2, A2), (M3, A3), a parable which includes these measurement points will be searched for. As a parable herein, the quadratic function $y=ax^2+bx+c$ with the mathematic constants a, b. c will be set up. The x-values correspond to the set values—which, in sector-field mass spectrometers, is in correspondence to the anode voltage—and the y-values correspond to the associated amplitude values. Then, using the measurement points, an equation system will be established and will be solved for the constants a and be. For b, the result will be $$b=(((A1-A3)/(M1^2-M3^2))-((A1-A2)/(M1^2-M2^2)))/(((M1-M3)/(M1^2-M3^2))-((M1-M2)/(M1^2-M2^2)))$$

and, for constant a, $$a=(A1-A2-b(M1-M2))/(M1^2-M2^2).$$

Subsequently, for determining the position of the maximum, the first derivative $y'=2ax+b$ of the quadratic function y will be set up and, after insertion of the computed constants a, b, this derivative will be solved for x. This x-value will then be the set value $M_{max}$ at which the development of the function is maximal. The set value of the maximum is $M_{max}=-b/2a$. On the basis of this set value, the amplitude of the searched molecule becomes maximal.

The invention claimed is:

1. A method for determining a molecular mass with the aid of mass spectroscopy, said method comprising the steps of:

predefining a first set value (M1) of the mass spectrometer, capturing the associated signal amplitude (A1), predefining a second set value (M2) differing from the first set value, measuring the associated second signal amplitude (A2), predefining a third set value (M3) differing from the first (M1) and the second (M2) set value, measuring the associated third signal amplitude (A3), obtaining a quadratic function containing the measured amplitude values as y-values and the predefined set values as x-values, determining the maximum of the quadratic function, the searched set value for the molecular mass being determined from the x-value of said maximum.

2. The method according to claim 1, wherein the quadratic function is a parable of the type $y=ax^2+bx+c$, its x-values corresponding to the predefined set values and its y-values corresponding to the measured amplitude values, and wherein a, b and c are mathematical constants.

3. The method according to claim 1, wherein amplitude values for at least three different set values and not more than ten set values are measured.

4. The method according to claim 1, wherein, after measurement of the three amplitude values and prior to determining said parable, it is examined whether the second amplitude value is higher than the first and the third amplitude value, wherein, if required, the measurements are repeated a sufficient number of times until the second amplitude value is higher than the first and the third amplitude value of a measurement.

5. The method according to claim 4, wherein the first set value of a repeated measurement corresponds to the third set value of the respective previous measurement.

6. The method according to claim 1, wherein the measurement of the first and the third amplitude value is repeated with set values whose distance to the second set value is smaller than at the respective previous measurement.

7. The method according to claim 6, wherein, when repeating said measurement, the maximum detected at the first measurement is used as the second set value.

8. The method according to claim 1, wherein, prior to each measurement of an amplitude value, it is first waited, after predefining the respective set value, until the amplitude signal has settled.

* * * * *